US005648139A

United States Patent [19]

Sussmann et al.

[11] Patent Number: 5,648,139

[45] Date of Patent: Jul. 15, 1997

[54] WIRE DRAWING DIES OF POLYCRYSTALLINE CVD DIAMOND WITH BORON DOPANT ATOMS

[76] Inventors: Ricardo Simon Sussmann, c/o Charters, Sunninghill, Berkshire; Cornelius Phaal, Glade Cottage, St Anne's Glade, Bagshot, Surrey GU19 5EF, both of England

[21] Appl. No.: 819,441

[22] Filed: Jan. 10, 1992

[30] Foreign Application Priority Data

Jan. 11, 1991 [GB] United Kingdom ..... 9100631

[51] Int. Cl.[6] ..... B21C 3/02; B23B 27/20

[52] U.S. Cl. ..... 428/131; 428/408; 428/704; 428/220; 51/307; 76/107.4; 76/107.1

[58] Field of Search ..... 428/131, 408, 428/704, 220; 51/307; 76/107.4, 107.1

[56] References Cited

U.S. PATENT DOCUMENTS

| | | | |
|---|---|---|---|
| 4,707,384 | 11/1987 | Schachmer et al. | 427/255.2 |
| 4,884,476 | 12/1989 | Okuzumi et al. | 76/101.1 |
| 5,020,394 | 6/1991 | Nakamura et al. | 76/108.6 |
| 5,033,334 | 7/1991 | Phaal et al. | 76/107.4 |

FOREIGN PATENT DOCUMENTS

| | | |
|---|---|---|
| 0197790 | 10/1986 | European Pat. Off. . |
| 0459425 | 12/1991 | European Pat. Off. . |
| WO79/00208 | 4/1979 | WIPO . |

OTHER PUBLICATIONS

Patent Abstracts of Japan, vol. 14, No. 544 (C–784), Dec. 4, 1990 & JP2233512, Sep. 17, 1990.

Patent Abstracts of Japan, vol. 9, No. 107 (M–378) (1830), May 11, 1985 & JP59–229227, Dec. 22, 1984.

Hirabayashi et al., "Triangular Structures on (111) Surfaces of Diamond Crystals Synthesized by the Hot–Filament CVD Method" *Japanese Journal of Applied Physics,* Col. 29, No. 10, Oct. 1990, pp. L1901–L1903.

Hirabayashi et al., "Growth Mode of (111) Surfaces of Diamond Crystals Synthesized by Hot–Filament CVD Method" *Japanese Journal of Applied Physics,* vol. 29, No. 10, Oct. 1990, pp. L1862–L1865.

*Primary Examiner*—William Watkins

*Attorney, Agent, or Firm*—Scully, Scott, Murphy and Presser

[57] ABSTRACT

A wire drawing die comprises a polycrystalline CVD diamond layer having a hole formed therethrough and mounted in a support.

7 Claims, 2 Drawing Sheets

WIRE DRAWING DIES OF POLYCRYSTALLINE CVD DIAMOND WITH BORON DOPANT ATOMS

BACKGROUND OF THE INVENTION

This invention relates to wire drawing dies of the type comprising a wear-resistant insert, such as a diamond insert or body, mounted in a suitable support.

Monocrystalline diamond wire drawing die inserts are extensively used in the industry. One of the drawbacks of monocrystalline diamond inserts for wire drawing dies is the fact that the inserts wear in a non-uniform pattern following crystallographic directions of lower wear resistance. As a consequence the cross section of the wire being drawn may change with time as the insert wears.

Further, monocrystalline diamond is intrinsically expensive to produce in large quantities.

A further problem with synthetically produced monocrystalline diamond relates either to metallic inclusions or a metallic phase present in the diamond crystals due to the synthesis process. This metallic component may lead to thermal instability resulting in premature wear or cracking.

Also presently used in the industry are wire drawing die inserts made of a polycrystalline diamond. This material does not present the preferential crystallographic wear pattern of crystalline inserts. However, it contains a metal binding face in its matrix such as cobalt which introduces an element of thermal instability in this material. Due to the presence of this matrix the wear is not always sufficiently smooth.

To avoid these and other problems introduced by the metal phase in polycrystalline diamond (PCD), some workers have resorted to leaching out the metal phase by chemical etching. Even this procedure presents disadvantages, however. First, it is difficult to achieve anything approximating complete and efficient removal of the metal phase. Second, the leaching removes the metal, leaving voids and results in a porous PCD material, the strength of which decreases with increasing porosity. Third, a porous structure is more difficult to polish to a smooth surface finish than a dense polycrystalline body.

Processes are known whereby diamond is synthesised in the gas phase. These methods are known as chemical vapour deposition (CVD) and the diamond produced by such processes is known as CVD diamond. These processes generally involve providing a mixture of hydrogen gas and a suitable gaseous carbon compound such as a hydrocarbon, applying sufficient energy to the gas to dissociate the hydrogen into atomic hydrogen and the gas into active carbon ions, atoms or CH radicals and allowing such active species to deposit on a substrate to form diamond. Dissociation of the gases can take place by a variety of methods such as hot filament, plasma assisted methods or plasma jet.

SUMMARY OF THE INVENTION

According to the invention, a wire drawing die blank comprises a polycrystalline CVD diamond body secured around its periphery to a support. A wire drawing die is produced from this blank by forming a hole through the body.

DESCRIPTION OF EMBODIMENTS

Figure 1:
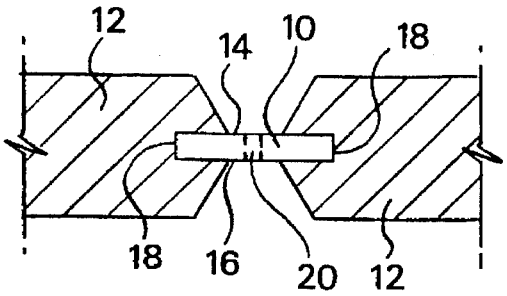
FIGS. 1 and 2 are fragmentary sectional side views of two embodiments of the invention.

The polycrystalline CVD diamond body will generally be in the form of a layer which typically has a thickness in excess of 0,5 mm. This layer or body will be mounted in a suitable support, as is known in wire drawing die technology. The relatively random distribution of crystal orientations in the CVD diamond ensures more even wear during use of the insert. Moreover, the CVD diamond is free of metal inclusions and therefore has a high thermal stability.

The grain size of CVD diamond can be controlled from under 1 micron to over tens of microns. This capability allows for the grading of the dies for different drawing applications.

Dopant atoms such as boron atoms can be introduced into the CVD diamond during growth. Thus, for example, the addition of boron in concentrations in excess of 1200 ppm will increase very substantially the oxidation resistance, and hence life, of the CVD diamond body or layer.

The growth process of CVD diamond can be tailored to produce layers with a preferred crystallographic orientation. This orientation can, for example, be (111), (110) or (100). It is known that the wear rate is strongly dependent on the orientation of diamond. Thus, the preferred orientation can be chosen to increase the wear resistance of the diamond body. For example, for diamond layers the orientation may be such that most of the crystallites have a (111) crystallographic axis in the plane of the layer.

The support for the CVD diamond body will typically be a cemented carbide or metal support. The insert will typically be secured around its periphery in the support by brazing, mechanically or a combination thereof.

The CVD diamond bodies may be produced by methods known in the art. For example, a self-supported layer can be prepared by either growing a CVD diamond layer on a substrate such as silicon or silicon carbide which is chemically etched away after growth, or by growing a CVD diamond layer on a metal substrate such as molybdenum to which the diamond layer will not adhere. In this latter case, the layer is simply removed from the substrate, after growth.

CVD diamond layers will generally be produced larger in area than that required for a wire drawing die. Such layers may be cut, for example, by laser cutting, into a variety of useful shapes such as hexagons, squares or discs, the sides of which may be tapered.

An alternative to laser cutting to produce the individual dies or blanks from a CVD diamond layer is the use of photolithography and dry etching such as plasma etching or reactive ion etching of the diamond. By way of example, when oxygen etching is used, after preparing the CVD diamond layer and removing it from the substrate, a layer of a suitable mask material such as titanium, chromium, gold, silicon dioxide or other material which will not degrade in an oxygen plasma environment, is deposited on a side, preferably the smooth side, of the plate by a conventional technique such as vacuum evaporation, plasma assisted chemical vapour deposition, sputtering or the like. This layer is then patterned by known photolithography and wet or dry etching techniques known in the semi-conductor field.

After the desired pattern has been formed on the masking layer, the diamond plate is introduced into a reaction chamber in which an oxidising atmosphere can be created, preferably by the excitation of plasma in an oxygen-containing gas mixture. The diamond is removed in the regions or areas which are not masked.

In place of oxygen, other active gases may be used including halogens such as chlorine or fluorine, introduced in the gas mixtures using techniques known in the semiconductor technology.

Figure 2:
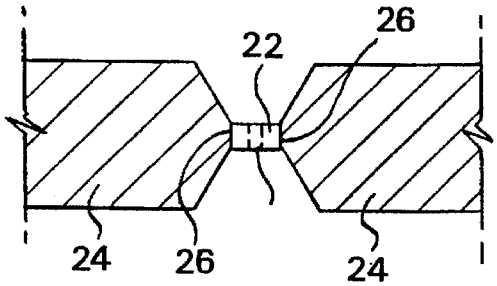

Two embodiments of wire drawing dies of the invention are illustrated by FIGS. 1 and 2. Referring first to FIG. 1, there is shown a wire drawing die comprising a polycrystalline CVD diamond layer 10 mounted in a support 12. The layer 10 has major flat surfaces 14, 16 on each of opposite sides thereof and is mounted in the support 12 such that the periphery 18 is well embedded therein. A hole 20 is formed through the layer 10 from the one major surface 14 to the other major surface 16. In use, wire is drawn through the hole.

The orientation of the diamond in the polycrystalline CVD diamond layer 10 may be such that most of the crystallites have a (111) crystallographic axis in the plane, i.e. parallel to the surfaces 14, 16, of the layer 10.

FIG. 2 illustrates a second embodiment. In this embodiment, a polycrystalline CVD diamond body 22 is secured to a support 24 by brazing the periphery 26 to the support. The braze is preferably a high temperature braze. A hole 28 is formed through the layer 22. This hole is axial or transverse to the general plane of the support.

The supports 12,24 will preferably be made of a suitable metal such as steel, but may also be made of cemented carbide.

Figure 3:
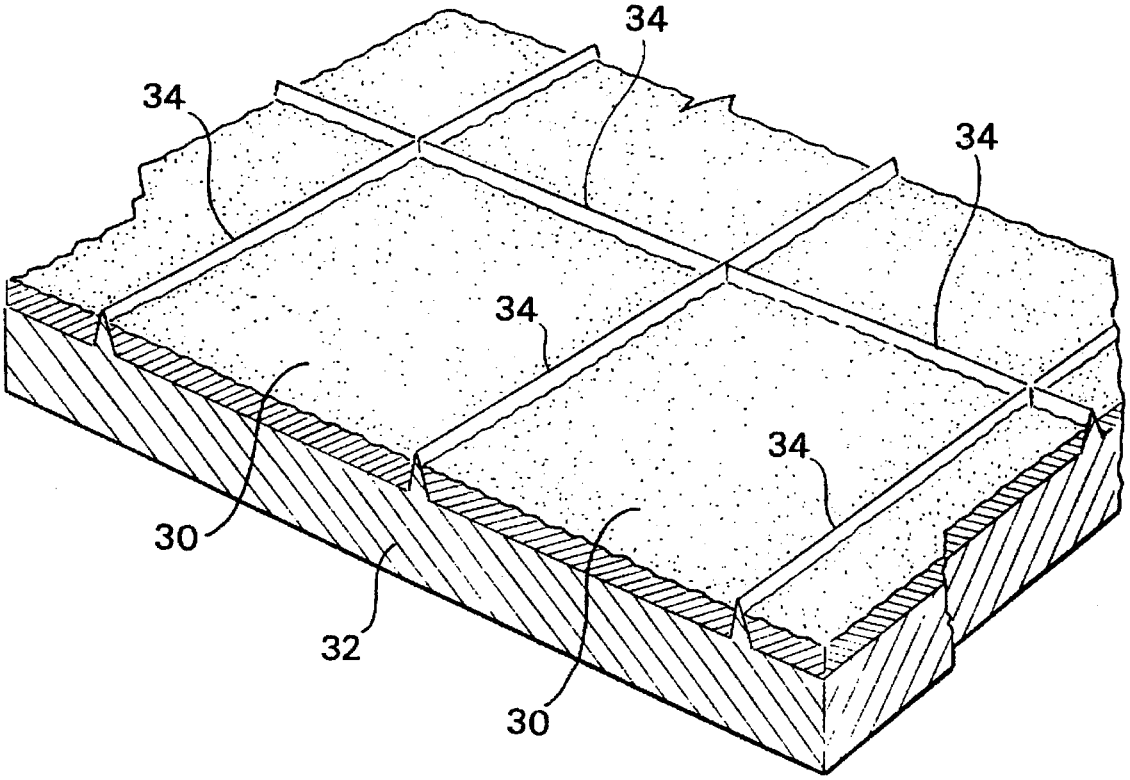
FIG. 3 is a perspective view of a product useful in making an insert for a wire drawing die of the invention.

FIG. 3 illustrates a product useful in producing a CVD diamond layer for either of the embodiments of FIGS. 1 and 2. A polycrystalline CVD diamond layer 30 is grown on a substrate 32 using any known CVD polycrystalline diamond method. The substrate 32 has a plurality of ridges 34 which define the desired shape and size of the CVD diamond layer to be produced. If the ridges 34 are of sufficient thickness there will be a break of the CVD diamond layer as it grows. The final product will then be a set of CVD diamond layers or inserts of the correct shape and size obviating the need for laser cutting or the like. Removal of the substrate and ridges, e.g. by chemical etching, releases the individual layers or inserts.

Figure 4:
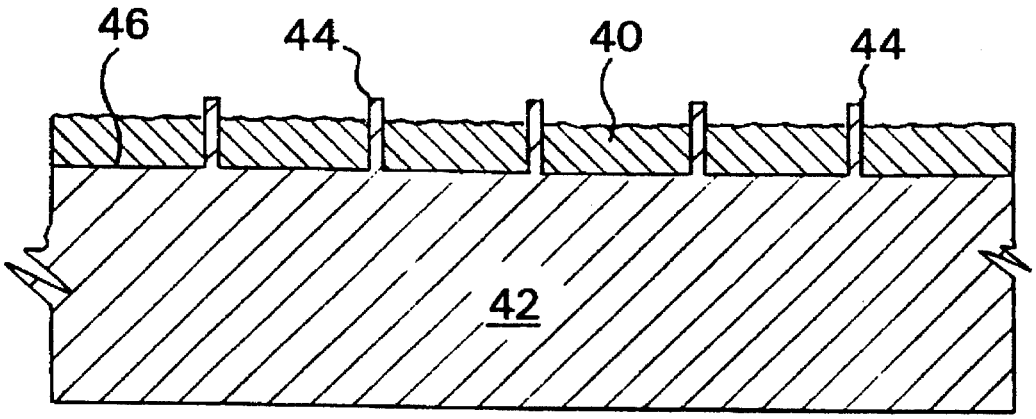
FIG. 4 is a sectional side view of another product useful in making such an insert.
Figure 5:
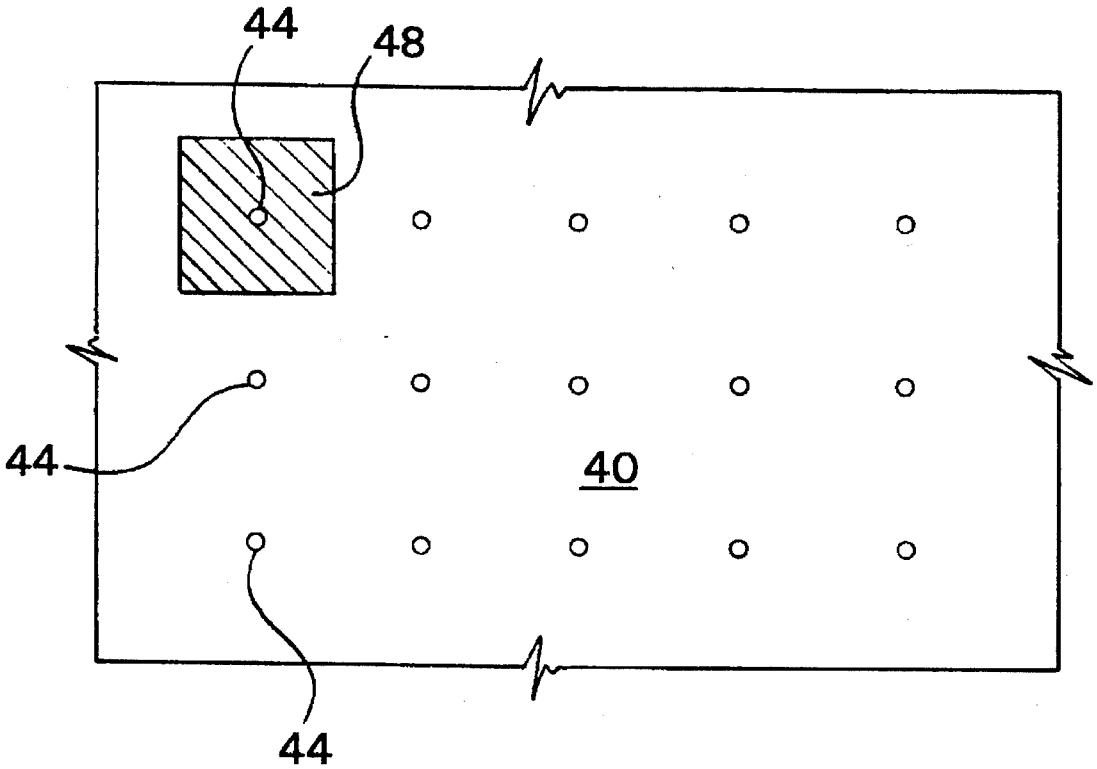
FIG. 5 is a plan view of FIG. 4.

FIGS. 4 and 5 illustrate another product useful in producing a CVD diamond insert for a wire drawing die. Referring to these Figures, a CVD polycrystalline diamond layer 40 is grown on a substrate 42. The substrate 42 has a plurality of cylindrical projections 44 extending from its surface 46. The diamond 40 will grow around these projections, as illustrated.

The product of FIGS. 4 and 5 can be fragmented into a number of squares 48, one of which is illustrated in FIG. 3. Each square 48 will have a projection 44 centrally located in it. The substrate may then be removed from each square leaving a square plate of CVD polycrystalline diamond having a hole extending therethrough. This plate is useful as an insert for a wire drawing die.

The projections can take on any suitable shape such as that of a bollard.

We claim:

1. A wire drawing die blank comprising a polycrystalline CVD diamond body comprised of a layer of polycrystalline CVD diamond having a concentration of boron dopant atoms in excess of 1200 ppm, wherein the orientation of the polycrystalline CVD diamond has most of the crystallites aligned with a (111) crystallographic axis in the plane of the layer, and a support to which the polycrystalline CVD diamond body is secured around its periphery.

2. A wire drawing die blank according to claim 1, wherein the layer of polycrystalline CVD diamond has a thickness; in excess of 0.5 mm.

3. A wire drawing die according to claim 1, wherein the periphery of the polycrystalline CVD diamond body is secured to the support by brazing.

4. A wire drawing die according to claim 1, wherein the periphery of the polycrystalline CVD diamond body is mechanically secured to the support.

5. A wire drawing die according to claim 1, wherein the periphery of the polycrystalline CVD diamond body is secured to the support mechanically and by brazing.

6. A wire drawing die blank according to claim 1, wherein the material of the support is selected from metal and cemented carbide.

7. A wire drawing die comprising a wire drawing die blank according to claim 1, having a hole formed through the polycrystalline CVD diamond body.

* * * * *